United States Patent [19]

Dakin et al.

[11] 4,228,642

[45] Oct. 21, 1980

[54] METHOD AND APPARATUS FOR STOPPING AN OPEN-END SPINNING MACHINE

[75] Inventors: John Dakin, Rossendale; Dennis O'Donnell, Oldham; Christopher J. Copple, Billington, nr. Whalley, all of England

[73] Assignee: Platt Saco Lowell Limited, Lancashire, England

[21] Appl. No.: 961,076

[22] Filed: Nov. 15, 1978

[30] Foreign Application Priority Data

Nov. 17, 1977 [GB] United Kingdom ..... 47802/77

[51] Int. Cl.³ ..... D01H 1/20; D01H 7/882

[52] U.S. Cl. ..... 57/263; 57/83; 57/264

[58] Field of Search ..... 57/58.89–58.95, 57/78–81, 83, 93, 100, 261, 263

[56] References Cited

U.S. PATENT DOCUMENTS

| | | | |
|---|---|---|---|
| 3,780,513 | 12/1973 | Watanabe et al. | 57/263 X |
| 3,791,128 | 2/1974 | Landwehrkamp et al. | 57/261 X |
| 3,939,638 | 2/1976 | Bruckert et al. | 57/263 |
| 4,033,107 | 7/1977 | Sasayama et al. | 57/263 X |
| 4,054,024 | 10/1977 | Tsubata et al. | 57/263 X |
| 4,083,169 | 4/1978 | Lane et al. | 57/263 |
| 4,100,722 | 7/1978 | Suzuki et al. | 57/263 |
| 4,102,116 | 7/1978 | Derichs et al. | 57/263 |
| 4,112,661 | 9/1978 | Suzuki et al. | 57/263 |

*Primary Examiner*—Donald Watkins
*Attorney, Agent, or Firm*—Donald H. Feldman

[57] ABSTRACT

In a controlled stopping procedure for an open-end spinning machine the fibre feed roller and the yarn delivery rollers decelerate in synchronism. A detector senses a predetermined speed of the yarn delivery rollers after a period of time from starting the deceleration and initiates the stopping of the fibre feed roller. After a further period of time, determined by time delay means, the decelerating yarn delivery rollers are braked. Preferably the yarn delivery rollers have come almost to rest when they are braked.

11 Claims, 1 Drawing Figure

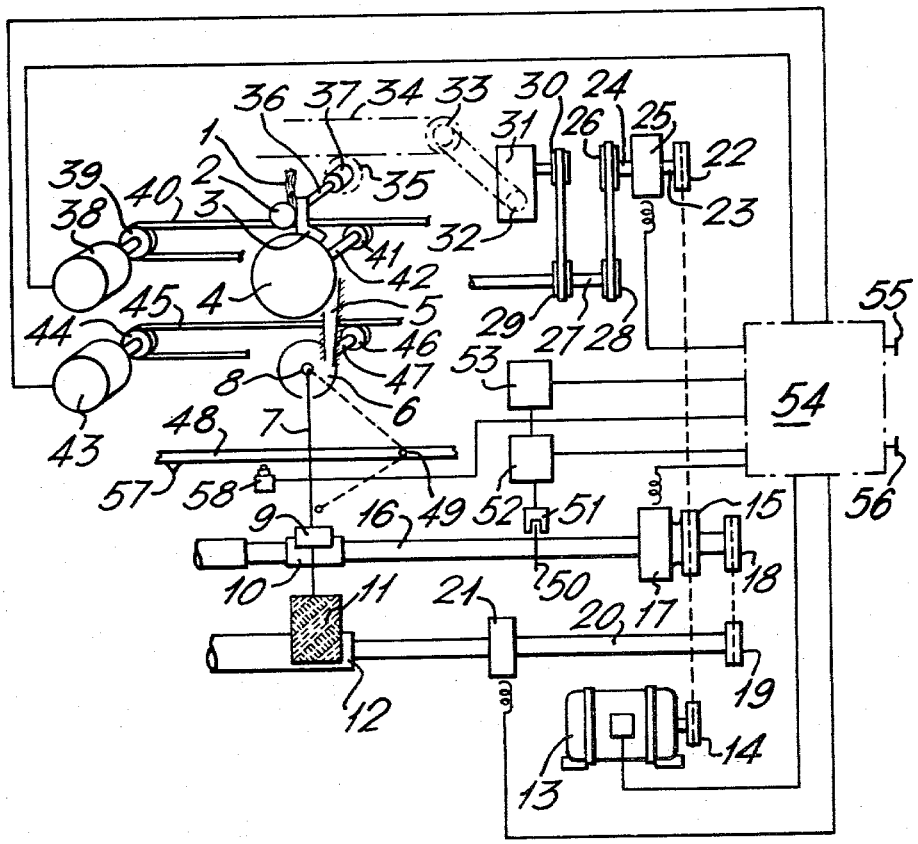
36
37
34
33
30
24
25
22
23
31
26
1
2
35
39
40
3
38
32
41
42
45
4
5
44
46
29
27
28
55
53
54
8
47
6
43
48
7
57
58
49
52
51
15
56
9
16
10
50
18
11
21
20
17
19
12
14
13

METHOD AND APPARATUS FOR STOPPING AN OPEN-END SPINNING MACHINE

FIELD OF THE INVENTION

This invention relates to open-end spinning machines for producing textile yarns and particularly to a method of and apparatus for stopping an open-end spinning machine in a controlled manner.

When terminating the spinning operation on an open-end spinning machine it is desirable to stop the machine so that, at all of the spinning positions, the end of yarn is not withdrawn out of the doffing tube, and that the end of yarn terminates at the correct position and has the desired tail shape. These features are desirable so that on starting the machine to recommence the spinning operation, successful piecing-up of the ends of yarn is achieved at all of the spinning positions, and at the location of the piecing the yarn possesses the desired yarn characteristics.

DESCRIPTION OF THE PRIOR ART

Several procedures for stopping an open-end spinning machine have hitherto been proposed, but these have possessed some drawbacks with the result that successful piecing-up at all positions of the machine has not subsequently been achieved.

In U.S. Pat. No. 3,791,128 a stopping procedure for an open-end spinning machine is disclosed, in which the fibre feed means, spinning means and yarn delivery means are decelerated from their normal spinning speed to a selected constant low spinning speed whilst maintaining constant speed ratios in relation to each other. At this constant low spinning speed the fibre feed means is stopped followed by stopping the yarn delivery rollers.

This procedure has been developed for open-end spinning machines having high production rates so that by lowering the speed of the machine to a preselected low spinning speed whilst maintaining the speed ratios of the spinning elements, the piecing-up of yarn and the changing of full yarn packages is facilitated. However, there is a minimum machine speed at which the production of yarn can take place satisfactorily. Since this minimum speed may be relatively high the stopping of the fibre feed means and particularly the braking of the yarn delivery rollers at this constant speed leads to complications. For this reason we do not believe that this known procedure provides satisfactory stopping of the machine.

In a further known stopping procedure, as disclosed in British Pat. No. 1,419,440, the motor driving the machine is first switched off and a brake applied to the fibre feed means so as to prevent further delivery of fibres to the spinning means. After stopping the fibre feed, the yarn delivery rollers continue to withdraw yarn from the spinning means.

A contactless detector is arranged so as to emit pulses to a counter device in response to the detection of calibrations marked on a disc attached to one of the yarn delivery rollers. Thus the pulses emitted by the detector correspond to the amount of yarn being delivered. After a predetermined length of yarn has been withdrawn, measured by the counter, a braking torque sufficient to slow down the delivery rollers is applied and then the braking torque increased to stop the delivery rollers.

Disadvantages accrue from this stopping procedure because the fibre feed is switched off at the normal spinning speed. Therefore to try to ensure that the end of yarn is not withdrawn completely from the spinning means it is necessary to apply a braking torque to the yarn delivery rollers whilst they are rotating at a relatively high rotational speed. As realised in this known arrangement to brake fully the delivery roller causes problems and an attempt to minimise these has been made by first applying to the delivery rollers a braking torque less than the full braking torque.

However this tends to complicate the control system, since it involves incorporating additional components into the control system and it also becomes difficult to ensure that the end of yarn terminates at the required position for subsequent successful piecing-up.

SUMMARY OF THE INVENTION

It is an object of this invention to provide a controlled stopping procedure for an open-end spinning machine so that on subsequent starting of the machine, successful piecing-up is achieved at all of the spinning stations.

The problem is solved according to the invention in that in a method of stopping an open-end spinning machine of the type comprising fibre feed means including a fibre feed roller, spinning means for forming a spun yarn from fibres fed thereto from the fibre feed means, and yarn delivery rollers for delivering a yarn formed by the spinning means, including the step of starting to decelerate the fibre feed roller and the yarn delivery rollers in synchronism, wherein the improvement comprises the step of stopping the fibre feed roller after a period of time from the start of the deceleration of the fibre feed roller and yarn delivery rollers and whilst continuing deceleration of the yarn delivery rollers, and then stopping the decelerating yarn delivery rollers a predetermined time after stopping the fibre feed roller.

Preferably the method includes the step of detecting a predetermined rotational speed of the decelerating fibre feed means or the decelerating yarn delivery rollers and emitting a signal in response thereto to initiate the stopping of the fibre feed means.

Further, there is provided apparatus for open-end spinning textile yarns comprising fibre feed means including a fibre feed roller, spinning means for forming spun yarn from fibres fed thereto from the fibre feed means, yarn delivery rollers for delivering yarn formed by the spinning means, drive means for transmitting drive to driven elements including the fibre feed roller and yarn delivery rollers so that they are rotated in synchronism and brake means for application to the yarn delivery rollers, and further comprising a control system including switch means for switching off the drive means to decelerate the driven elements including the fibre feed roller and yarn delivery rollers in synchronism, wherein the control system includes a detector for sensing the rotational speed of the driven elements and so set to respond at a predetermined speed thereof to stop the fibre feed roller, and a time delay means so set to initiate actuation of the brake means a predetermined time after the response of the detector to stop the decelerating yarn delivery rollers.

BRIEF DESCRIPTION OF THE DRAWING

The accompanying drawing which shows, diagrammatically, an open-end spinning machine equipped with a control system for stopping the machine in accordance with the invention.

DESCRIPTION OF THE PREFERRED EMBODIMENTS

Only one spinning station is described hereinafter, but it will be appreciated that the machine comprises a plurality of such stations.

Referring to the drawings, at each spinning station a sliver 1 is forwarded between the nip formed by a feed roller 2 and a feed plate 3 to the action of an opening roller 4. The fibres are removed from the opening roller 4 and transferred in an airstream down a fibre feed duct 5 to a spinning rotor 6. Spun yarn 7 is withdrawn from the spinning rotor 6 through a doffing tube 8 by a pair of delivery rollers 9, 10, and wound up on a package 11 driven by a driving roller 12.

A main driving motor 13 has a gear wheel 14 fixed to the output shaft thereof. The gear wheel 14 is drivingly connected to a gear wheel 15 mounted on an extension 16, which is drivingly connected to the delivery roller 10 of each spinning unit. Associated with the gear wheel 15 is an electro-magnetic clutch 17, which when actuated, establishes a connection between the gear wheel 15 and the delivery roller extension 16. the delivery roller extension 16 extends through the clutch 17 and the gear wheel 15 to provide a seating for an output gear wheel 18. The output gear wheel 18 is drivingly connected to a gear wheel 19 fixed at one end of an extension 20 which is drivingly connected to the package driving roller 12 of each spinning unit. An electromagnetically operated brake 21 if also provided on the package driving roller extension 20.

A drive transmission connects the gear wheel 15 with a gear wheel 22 mounted on one end of a countershaft 23 which is connected to a further countershaft 24 by means of an electro-magnetic fibre feed roller main clutch 25. A pulley 26 is mounted on the end of the countershaft 24 from which a drive is transmitted to the layshaft 27 by means of a pulley 28 fixed at one end thereof.

The layshaft 27 extends along the machine and at intervals therealong a pulley 29 is attached to transmit the drive to a pulley 30 mounted on the input shaft to a gear box 31. A pulley 32 mounted on the gear box output shaft transmits the drive to a chain drive wheel 33 driving a chain 34. The chain 34 serves a group of spinning units, and at each unit engages a feed roller chain wheel 35 mounted on a feed roller shaft 36 to transmit the drive to the feed roller 2. On each feed roller shaft 36 is an individual feed roller clutch 37.

The drive for the opening roller 4 is derived from an opening roller motor 38 on the output shaft of which is mounted a pulley 39. The pulley 39 drives a driving belt 40 which extends along the machine and at each spinning station contacts an opening roller drive pulley 41 mounted on an opening roller shaft 42, which, in operation, imparts a drive to the opening roller 4.

In a similar manner, the drive for the spinning rotor 6 is derived from a spinning rotor motor 43 on the output shaft of which is mounted a pulley 44. The pulley 44 drives a driving belt 45 which extends along the machine and at each station contacts a rotor drive pulley 46 mounted on a rotor shaft 47, which, in operation, imparts a drive to the rotor 6.

At each spinning station, there is provided the facility for forming a reserve length of yarn comprising a reserve loop or length forming bar 48 having fixed thereto a yarn guide 49. The bar 48 can be moved to an extended position in which the yarn 7 is constrained by the yarn guide 49 to follow an extended path, as shown in broken line, and to a retracted position in which the yarn 7 is permitted to follow a shortened path, as shown in full line.

Attached to the delivery roller extension 16 is a disc 50 provided with equally spaced markings. Upon rotation of the delivery roller extension 16, these markings are sensed by a detector 51 which, in consequence thereof, emits pulses to a pulse counter 52. The pulse counter 52 is connected to a time delay device 53, the purpose of which is hereinafter described, which is in operative connection with a main control circuit generally indicated at 54. The control circuit 54 is provided with a start button 55 and a stop button 56 and includes a programming device (not shown) connected with the various electrically operated elements so that they can be controlled according to a predetermined sequence during starting and stopping the machine.

The spinning machine operates as follows:

During the spinning operation, the silver 1 is forwarded by the feed roller 2 co-operating with the feed plate 3 to the opening action effected by the opening roller 4. the fibres are transferred, in an airstream, down the fibre feed duct 5 to the spinning rotor 6 from which they are withdrawn as a spun yarn 7 by a pair of delivery rollers 9, 10, to be wound on the package 11. The yarn reserve forming bar 48 is in the retracted position and thus the yarn 7 follows the shortened path, as shown in full lines, between the doffing tube 8 and the yarn delivery rollers 9, 10.

When it is desired to stop the machine, the stop button 56 is depressed so that the control circuit 54 controls automatically the stopping of the machine in accordance with a predetermined sequence. Firstly, the yarn reserve forming bar 48 is caused to move slowly to the right so that the yarn guide 49 transfers the yarn 7 to the extended position as indicated in broken line. In this position, a projection 57 on the yarn reserve forming bar 48 actuates a micro-switch 58 which is effective to switch off the motor 13. The motor 13 decelerates and, in consequence thereof, the feed roller 2, the delivery rollers 9, 10, and the package driving roller 12 also decelerates. Since the delivery roller clutch 17 and the main feed roller clutch 25 are in operation, the feed roller 2, the delivery rollers 9, 10, and the package driving roller 12 all decelerate in synchronism. Thus the desired characteristics of the spun yarn are maintained.

At the time of switching off the motor 13, the detector 51 and the pulse counter 52 are brought into operation.

The markings on the disc 50 are converted into pulses by the detector 51, the frequency of these pulses being a measure of the speed of the delivery rollers 9, 10. The pulse counter 52 has been pre-set to emit a signal to the control circuit 54 when a predetermined speed of the delivery rollers 9, 10 is reached. At this predetermined speed, which may typically be in the region of 500 r.p.m. and is lower than the normal production speed of, say 1,000 r.p.m., the pulse counter 52 emits a signal to the control circuit 54 and results in the disengagement of the main feed roller clutch 25 whereby the drive to the feed roller 2 is disconnected. The feed roller 2 stops rotation almost instantaneously and thus feeding of fibres to the spinning rotor 6 is terminated. Also at this predetermined speed the pulse counter 52 starts operation of the time delay device 53, which is set to emit a signal to the control circuit 54 a set time after the said predetermined speed of the delivery roller is reached.

The delivery rollers 9, 10 and the package driving roller 12 continue to decelerate until termination of the pre-set time when the signal emitted by the time delay device 53 causes the control circuit 54 to initiate disengagement of the delivery roller clutch 17 and actuation of the brake 21. As a result the shafts 16 and 20 are stopped and delivery of spun yarn 7 from the spinning rotor 6 is terminated.

Delay timers in the control circuit 54 are then actuated to switch off the opening roller motor 38 and the spinning rotor motor 43, thus allowing the opening roller 4 and the spinning rotor 6 to decelerate to rest.

It is important that the time delay devices 53 initiates disengagement of the clutch 17 and engagement of the brake 21 when the delivery rollers 9, 10, have very nearly stopped rotating. Preferably, when the brake 21 is engaged, the speed of the delivery rollers 9, 10 is in the region of 10 r.p.m. and, in any event, is less that 100 r.p.m. Thus, the only brake applied to the rotating parts of the machine is the brake 21, which acts on the shaft 20 to terminate delivery of yarn 7 by the delivery rollers 9, 10, when this shaft has almost come to rest. Thus the effects of braking on the rotating machine parts are advantageously minimised. The actuation of the brake 21 is used as the datum from which the set time is calculated at which the pulse counter 52 should emit its signal to actuate the disengagement of the feed roller main clutch 25. This set time is calculated so that the rotating spinning rotor 6 twists off the end of yarn. Furthermore, upon termination of the spinning operation, the end of yarn must be spaced from the fibre collecting surface of the rotor 6 by a specific amount and not withdrawn from the doffing tube, so that on recommencing the spinning operation, when the reserve forming bar 48 is moved to the retracted position, this end of yarn will make the desired contact with fibres fed to the fibre collecting surface.

It will be appreciated that the detector 51 could be arranged to sense the speed of rotation of parts of the machine, other than the shaft 16, which derive their rotation from the motor 13. For example, the detector 51 may be positioned so as to sense the speed of the fibre feed means, for example the shaft 27, or the speed of the motor 13, where the speed of the gear wheel 14 may be sensed, and a signal emitted to the time delay device 53 in response to the detection of a predetermined speed of these components during their deceleration.

We claim:

1. A method of stopping an open-end spinning machine of the type comprising fibre feed means including a fibre feed roller, spinning means for forming a spun yarn from fibres fed thereto from the fibre feed means, and yarn delivery rollers for delivering a yarn formed by the spinning means, including the step of starting to decelerate the fibre feed roller and yarn delivery rollers so that they decelerate in synchronism, wherein the improvement comprises the step of stopping the fibre feed roller after a period of time from the start of the deceleration of the fibre feed roller and yarn delivery rollers and whilst continuing deceleration of the yarn delivery rollers, and then stopping the decelerating yarn delivery rollers a predetermined time after the fibre feed roller.

2. A method according to claim 1, wherein the method includes the step of detecting a predetermined rotational speed of the decelerating fibre feed roller or the decelerating yarn delivery rollers and emitting a signal in response thereto to initiate the stopping of the fibre feed roller.

3. A method according to claim 2, wherein the method includes the step of detecting a predetermined rotational speed of the decelerating yarn delivery rollers.

4. A method according to claim 3, wherein the predetermined rotational speed of the yarn delivery rollers is less than 500 r.p.m.

5. A method according to claim 4, wherein the step of stopping the yarn delivery rollers takes place when the rollers have decelerated almost to rest.

6. A method according to claim 4, wherein the step of stopping the yarn delivery rollers takes place at a yarn delivery roller speed in the region of 10 r.p.m.

7. A method according to claim 1, wherein the method includes the step of extending a path of yarn between the spinning means and the yarn delivery rollers before the step of decelerating the fibre feed means and the yarn delivery rollers.

8. A method according to claim 1, wherein the spinning means is maintained in operation after stopping the yarn delivery rollers, whereby to twist off the end of yarn.

9. Apparatus for open-end spinning textile yarns, comprising fibre feed means including a fibre feed roller, spinning means for forming spun yarn from fibres fed thereto from the fibre feed means, yarn delivery rollers for delivering a yarn formed by the spinning means, drive means for transmitting drive to driven elements including the fibre feed roller and yarn delivery rollers so that they are rotated in synchronism, and brake means for application to the yarn delivery rollers, and further comprising a control system including switching means for switching off the drive means to cause the drive means to decelerate the driven elements including the fibre feed roller and yarn delivery rollers in synchronism, wherein the control system includes a detector for sensing the rotational speed of the driven elements and so set to respond at a predetermined speed thereof to stop the fibre feed roller, and a time delay means so set to initiate actuation of the brake means a predetermined time after the response of the detector to stop the decelerating yarn delivery rollers.

10. Apparatus according to claim 9, wherein the detector is so arranged as to sense the rotational speed of the yarn delivery rollers.

11. Apparatus according to claim 9, wherein yarn reserve forming means are provided so as to extend a path of yarn between the spinning means and the yarn delivery rollers.

* * * * *